US008094098B2

(12) United States Patent
Lee

(10) Patent No.: US 8,094,098 B2
(45) **Date of Patent: *Jan. 10, 2012**

(54) ORGANIC LIGHT EMITTING DISPLAY DEVICE AND DRIVING METHOD THEREOF

(75) Inventor: Wook Lee, Suwon (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 992 days.

This patent is subject to a terminal disclaimer.

(21) Appl. No.: 11/861,112

(22) Filed: Sep. 25, 2007

(65) Prior Publication Data

US 2008/0186262 A1 Aug. 7, 2008

(30) Foreign Application Priority Data

Feb. 5, 2007 (KR) ..... 10-2007-0011784

(51) Int. Cl.
*G09G 3/30* (2006.01)

(52) U.S. Cl. ..... 345/77; 345/76; 345/204

(58) Field of Classification Search ..... 345/36, 345/38–39, 45–48, 76–77, 81–84, 87–90, 345/204, 207, 214, 690, 698–699; 315/169.3
See application file for complete search history.

(56) References Cited

U.S. PATENT DOCUMENTS

| | | | | |
|---|---|---|---|---|
| 5,315,694 | A | 5/1994 | Kasano | |
| 5,754,150 | A | 5/1998 | Matsui | |
| 7,369,183 | B2 * | 5/2008 | Oka et al. | 348/674 |
| 7,656,383 | B2 | 2/2010 | Hedrick | |
| 7,679,602 | B2 | 3/2010 | Owyeung et al. | |
| 7,724,247 | B2 | 5/2010 | Yamazaki et al. | |
| 7,728,526 | B2 | 6/2010 | Lee | |
| 7,746,317 | B2 * | 6/2010 | Fu et al. | 345/102 |
| 7,782,279 | B2 | 8/2010 | Lee et al. | |
| 7,839,091 | B2 * | 11/2010 | Kohashikawa et al. | 315/151 |

(Continued)

FOREIGN PATENT DOCUMENTS

JP 2000-221944 8/2000

(Continued)

OTHER PUBLICATIONS

Korean Patent Abstracts, Publication No. 1020060112997, dated Nov. 2, 2006, in the name of Young Jong Park et al.

(Continued)

*Primary Examiner* — Richard Hjerpe
*Assistant Examiner* — Mansour M Said
(74) *Attorney, Agent, or Firm* — Christie, Parker & Hale, LLP

(57) ABSTRACT

An organic light emitting display device includes a display area including a plurality of pixels connected to scan lines, light emission control lines and data lines; a scan driver electrically connected to the display area through the scan lines and light emission control lines; a data driver electrically connected to the display area through the data lines; an optical sensor for generating an optical sensor signal corresponding to the brightness of the ambient light; a first luminance control unit for providing a first luminance control signal for controlling a gamma-corrected gray level voltage of a data signal in accordance with the optical sensor signal; and a second luminance control unit for providing a second luminance control signal for controlling a pulse width of the light emission control signal in accordance with the optical sensor signal and the data of one frame.

13 Claims, 7 Drawing Sheets

U.S. PATENT DOCUMENTS

| | | | | |
|---|---|---|---|---|
| 2002/0011978 | A1 | 1/2002 | Yamazaki et al. | |
| 2004/0041928 | A1* | 3/2004 | Hirakoso et al. | 348/254 |
| 2005/0057191 | A1* | 3/2005 | Jo et al. | 315/291 |
| 2005/0253835 | A1 | 11/2005 | Kawase | |
| 2006/0001624 | A1* | 1/2006 | Lee | 345/82 |
| 2006/0114205 | A1* | 6/2006 | Shen et al. | 345/88 |
| 2006/0244387 | A1 | 11/2006 | Park et al. | |
| 2007/0146302 | A1* | 6/2007 | Liu et al. | 345/102 |
| 2008/0186263 | A1 | 8/2008 | Lee | |
| 2008/0186264 | A1 | 8/2008 | Lee | |
| 2008/0204438 | A1 | 8/2008 | Song et al. | |
| 2008/0246699 | A1 | 10/2008 | Oh | |
| 2009/0166510 | A1 | 7/2009 | Park et al. | |

FOREIGN PATENT DOCUMENTS

| | | | |
|---|---|---|---|
| JP | 2001-134255 | | 5/2001 |
| JP | 2005-308857 | | 11/2005 |
| JP | 2007-025317 | | 2/2007 |
| KR | 1992-0004293 | B1 | 6/1992 |
| KR | 1999-0030441 | U | 7/1999 |
| KR | 10-2000-0033177 | | 6/2000 |
| KR | 10-2004-0015910 | | 2/2004 |
| KR | 10-2005-0099303 | | 10/2005 |
| KR | 10-2006-0010912 | | 2/2006 |
| KR | 10-2006-0012738 | | 2/2006 |
| KR | 10-2006-0035831 | | 4/2006 |
| KR | 10-2006-0078590 | | 7/2006 |
| KR | 10-2006-0079573 | | 7/2006 |
| KR | 10-0629587 | B1 | 9/2006 |
| KR | 10-2006-0112997 | | 11/2006 |
| KR | 10-2006-0113009 | | 11/2006 |
| KR | 10-2006-0120643 | | 11/2006 |

OTHER PUBLICATIONS

Korean Patent Abstracts, Publication No. 1020060113009, dated Nov. 2, 2006, in the name of Jae Sung Lee et al.

Korean Patent Abstracts, Publication No. 1020060035831 A, Published on Apr. 27, 2006, in the name of Lee.

Korean Patent Abstracts, Publication No. 1020060079573 A, Published on Jul. 6, 2006, in the name of Kwon.

U.S. Office action dated Sep. 1, 2010, for related U.S. Appl. No. 11/861,107.

U.S. Office action dated Sep. 16, 2010, for related U.S. Appl. No. 11/861,109.

U.S. Office action dated Sep. 16, 2010, for related U.S. Appl. No. 11/861,128.

U.S. Notice of Allowance dated Feb. 7, 2011, for cross reference U.S. Appl. No. 11/861,107, noting references in this IDS.

U.S. Notice of Allowance dated Feb. 8, 2011, for cross reference U.S. Appl. No. 11/861,109, noting references in this IDS.

U.S. Office action dated Apr. 18, 2011, for cross reference U.S. Appl. No. 11/861,109.

KIPO Office action dated Mar. 27, 2008, for Korean Patent application 10-2007-0018657, 7 pages.

Korean Patent Abstract for Korean Publication 10-1990-0003762, dated Mar. 27, 1990, corresponding to Korean Patent 192-0004293 listed above.

U.S. Office action dated Mar. 18, 2011, for cross-reference U.S. Appl. No. 11/902,649, 16 pages.

* cited by examiner

FIG. 7

635

| UPPER 5-BIT VALUE (CONTROL DATA) | LIGHT EMITTING RATE | LIGHT EMITTING RATIO | LUMINANCE | EW (HSYNC) |
|---|---|---|---|---|
| 0 | 0% | 100% | 300 | 325 |
| 1 | 4% | 100% | 300 | 325 |
| 2 | 7% | 100% | 300 | 325 |
| 3 | 11% | 100% | 300 | 325 |
| 4 | 14% | 100% | 300 | 325 |
| 5 | 18% | 99% | 298 | 322 |
| 6 | 22% | 98% | 295 | 320 |
| 7 | 25% | 95% | 285 | 309 |
| 8 | 29% | 92% | 275 | 298 |
| 9 | 33% | 88% | 263 | 284 |
| 10 | 36% | 83% | 250 | 271 |
| 11 | 40% | 79% | 237 | 257 |
| 12 | 43% | 75% | 224 | 243 |
| 13 | 47% | 70% | 209 | 226 |
| 14 | 51% | 64% | 193 | 209 |
| 15 | 54% | 61% | 182 | 197 |
| 16 | 58% | 57% | 170 | 184 |
| 17 | 61% | 53% | 160 | 173 |
| 18 | 65% | 50% | 150 | 163 |
| 19 | 69% | 48% | 143 | 155 |
| 20 | 72% | 45% | 136 | 147 |
| 21 | 76% | 43% | 130 | 141 |
| 22 | 79% | 41% | 124 | 134 |
| 23 | 83% | 40% | 119 | 128 |
| 24 | 87% | 38% | 113 | 122 |
| 25 | 90% | 36% | 109 | 118 |
| 26 | 94% | 35% | 104 | 113 |
| 27 | 98% | 34% | 101 | 109 |
| 28 | – | – | – | – |
| 29 | – | – | – | – |
| 30 | – | – | – | – |
| 31 | – | – | – | – |

ORGANIC LIGHT EMITTING DISPLAY DEVICE AND DRIVING METHOD THEREOF

CROSS-REFERENCE TO RELATED APPLICATIONS

This application claims priority to and the benefit of Korean Patent Application No. 10-2007-0011784, filed on Feb. 5, 2007, in the Korean Intellectual Property Office, the entire content of which is incorporated herein by reference.

BACKGROUND

1. Field of the Invention

The present invention relates to an organic light emitting display device and a driving method thereof.

2. Discussion of Related Art

In recent years, various flat panel displays, which have reduced weight and volume compared to cathode ray tubes, have been developed. In particular, organic light emitting diode display devices have attracted public attention, because the organic light emitting diode display devices have an excellent luminance and color purity since organic compounds are used as light emission material.

Such an organic light emitting display device is expected to be effectively used for portable display devices, and the like, since it is thin and light-weight and may be driven at a low electric power.

However, conventional organic light emitting display devices emit light with a constant luminance regardless of surrounding brightness, and therefore their visibility is varied according to the surrounding brightness even if an image is displayed with the same gray levels. For example, an image, which is displayed when the surrounding brightness is high, has a reduced visibility, compared to an image displayed when the surrounding brightness is low.

Also, in conventional organic light emitting display devices, the amount of electric current that flows to a display area increases as the number of pixels that emit light during one frame period increases. Further, if there are pixels among the light-emitting pixels, that display high gray levels, a larger amount of electric current flows to the display area, resulting in increased power consumption.

SUMMARY OF THE INVENTION

Accordingly, one exemplary embodiment of the present invention is an organic light emitting display device capable of controlling a luminance according to brightness of the ambient light and data of one frame, reducing power consumption, and also preventing excessive reduction of luminance, and a driving method thereof.

In an exemplary embodiment according to the present invention, an organic light emitting display device for displaying an image is provided. The organic light emitting display device includes a display area including a plurality of pixels coupled to scan lines, light emission control lines and data lines; a scan driver electrically coupled to the display area through the scan lines and the light emission control lines; a data driver electrically coupled to the display area through the data lines; an optical sensor for generating an optical sensor signal corresponding to a brightness of an ambient light; a first luminance control unit for providing to the data driver a first luminance control signal for controlling a gamma-corrected gray level voltage of a data signal applied to the data lines, in accordance with the optical sensor signal; and a second luminance control unit for providing to the scan driver a second luminance control signal for controlling a width of a light emission control signal applied to the light emission control lines, in accordance with the optical sensor signal and the data of one frame.

The second luminance control unit may be turned on or off according to the optical sensor signal. The second luminance control unit may be turned off when the optical sensor signal has a lower value than a reference value, and turned on when the optical sensor signal has a higher value than the reference value. The first luminance control unit may include an analog/digital converter for converting the optical sensor signal, which is an analog signal, into a digital sensor signal; a counter for counting pulses to generate a counting signal during one frame period; a converter processor for outputting a control signal corresponding to the digital sensor signal and the counting signal; a register generation unit for dividing a brightness of the ambient light into a plurality of brightness levels and storing a plurality of register set values corresponding to the brightness levels; a first selection unit for selecting one register set value corresponding to the control signal outputted by the converter processor, among the plurality of the register set values stored in the register generation unit and outputting the selected one register set value; and a gamma correction unit for generating the first luminance control signal, which is a gamma correction signal, corresponding to the selected one register set value supplied from the first selection unit. The gamma correction signal may be set so that a luminance of the display area is reduced if the digital sensor signal corresponds to a dark brightness level of the ambient light. The second luminance control unit may include a data sum-up unit for summing up the data of one frame to generate sum-up data and generating, as control data, at least two bit values including most significant bits of the sum-up data; a lookup table for storing a width information of the light emission control signal corresponding to the control data; a controller for extracting the width information of the light emission control signal corresponding to the control data from the lookup table; and a second luminance control signal generation unit for generating the second luminance control signal corresponding to the width information of the light emission control signal supplied from the controller. The width of the light emission control signal may be set so that a luminance of the display area is decreased with an increasing value of the control data. The second luminance control unit may further include a switch unit for transmitting the data of one frame to the data sum-up unit or interrupting transmission of the data of the one frame to the data sum-up unit according to the optical sensor signal.

In another exemplary embodiment according to the present invention, a method for driving an organic light emitting display device is provided. The method includes: generating an optical sensor signal corresponding to a brightness of an ambient light; generating a first luminance control signal for controlling a gamma-corrected gray level voltage of a data signal according to the optical sensor signal; controlling a luminance of a display area by using the data signal corresponding to the first luminance control signal; and determining whether or not a light emission time of the pixels is controlled according to the optical sensor signal.

The optical sensor signal may be used to release limitation of the light emission time of the pixels if it has a lower value than a reference value, and the optical sensor signal may be used to limit the light emission time of the pixels if it has a higher value than the reference value. The method may further include generating a second luminance control signal for controlling a width of the light emission control signal according to the optical sensor signal and data of one frame if the optical sensor signal has a value greater than the reference value. Said generating the second luminance control signal may include: generating sum-up data by adding up the data of one frame; extracting a width of the light emission control signal corresponding to the sum-up data; and generating the second luminance control signal according to the extracted width of the light emission control signal. Said generating the first luminance control signal includes: converting the optical sensor signal into a digital sensor signal; counting pulses to generate a counting signal during one frame period; outputting the control signal corresponding to the digital sensor signal and the counting signal; selecting one register set value corresponding to the control signal among the previously set register set values and outputting the selected register set value; and generating a first luminance control signal corresponding to the one register set value.

BRIEF DESCRIPTION OF THE DRAWINGS

These and/or other aspects and features of the invention will become apparent and more readily appreciated from the following description of the exemplary embodiments, taken in conjunction with the accompanying drawings of which:

FIG. 7 is an exemplary embodiment of a table illustrating values of a lookup table shown in FIG. 6.

DESCRIPTION OF MAJOR PARTS IN THE FIGURES

Figure 1:
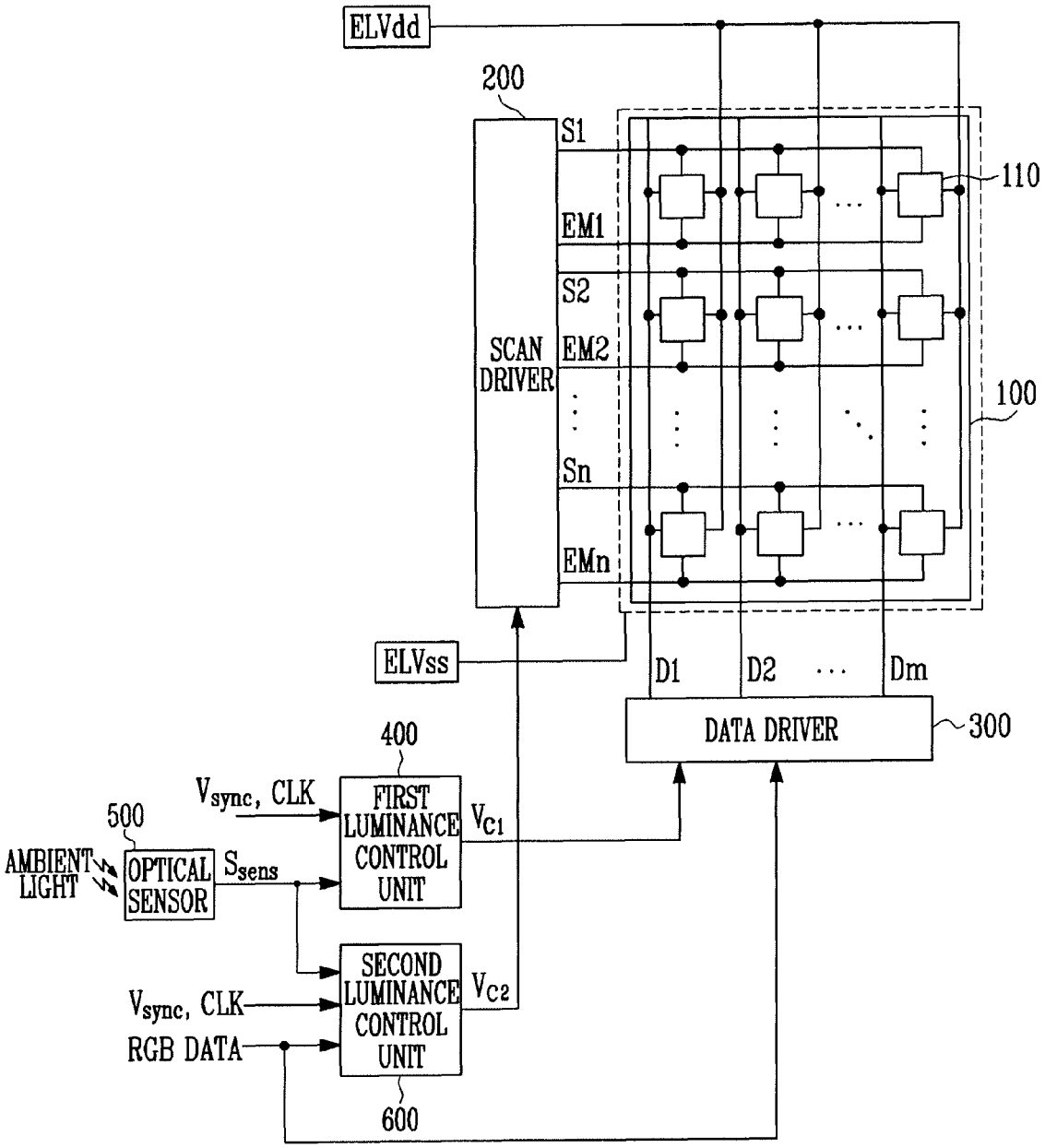
FIG. 1 is a block diagram showing a configuration of an organic light emitting display device according to one exemplary embodiment of the present invention.

| | |
|---|---|
| 100: display area | 200: scan driver |
| 300: data driver | 400: first luminance control unit |
| 500: optical sensor | 600: second luminance control unit |

DETAILED DESCRIPTION OF EMBODIMENTS

Hereinafter, exemplary embodiments according to the present invention will be described with reference to the accompanying drawings. Here, when one element is described as being connected to another element, one element may be not only directly connected to another element but instead may be indirectly connected to another element via one or more other elements. Further, some of the elements that are not essential to the complete description of the invention have been omitted for clarity. Also, like reference numerals refer to like elements throughout.

Exemplary embodiments according to the present invention provide an organic light emitting display device capable of controlling luminance according to a brightness of the ambient light and data of one frame. The embodiments of the present invention may result in reduced power consumption.

If the brightness of the ambient light and the luminance corresponding to data of one frame are both employed to reduce or limit a luminance of a display area, then the luminance of the display area may be excessively reduced, resulting in deteriorated visibility. Therefore, in an exemplary embodiment according the present invention, when the brightness level of the ambient light is below a reference level (e.g., a predetermined or preset brightness level), the data of one frame is not used to further reduce or limit the luminance of the display area.

FIG. 1 is a block diagram showing a configuration of an organic light emitting display device according to one exemplary embodiment of the present invention.

Referring to FIG. 1, the organic light emitting display device according to one exemplary embodiment of the present invention includes a display area 100, a scan driver 200, a data driver 300, a first luminance control unit 400, an optical sensor 500 and a second luminance control unit 600.

The display area 100 includes a plurality of pixels 110 connected to scan lines (S1 to Sn), light emission control lines (EM1 to EMn) and data lines (D1 to Dm). Here, one pixel 110 has at least one organic light emitting diode and may be composed of at least two subpixels which emit lights having different colors, each subpixel having one organic light emitting diode having a corresponding color.

The display area 100 displays an image in accordance with a first power source (ELVdd) and a second power source (ELVss) supplied from the outside, a scan signal and a light emission control signal supplied from the scan driver 200, and a data signal supplied from the data driver 300.

The scan driver 200 is electrically connected with the display area 100 through the scan lines (S1 to Sn) and the light emission control lines (EM1 to EMn). The scan driver 200 generates the scan signal and the light emission control signal. The scan signal generated in the scan driver 200 is sequentially supplied to each of the scan lines (S1 to Sn), and the light emission control signal is sequentially supplied to each of the light emission control lines (EM1 to EMn).

Here, a pulse width (or width) of the light emission control signal generated in the scan driver 200 is controlled by using a second luminance control signal (Vc2) when the second luminance control signal (Vc2) is supplied from the second luminance control unit 600. As described above, when the pulse width of the light emission control signal is controlled, a light emission time of the pixels 110 is varied, resulting in adjustment of the entire brightness of the display area 100.

The data driver 300 is electrically connected with the display area 100 through the data lines (D1 to Dm). The data driver 300 generates a data signal corresponding to image data (RGB Data) inputted thereinto and a gamma correction signal (a first luminance control signal (Vc1)) supplied from the first luminance control unit 400 during one frame period. The data signal generated in the data driver 300 is supplied to the data lines (D1 to Dm), and then supplied to each of the pixels 110 in synchronization with the scan signal.

Here, a gray level voltage of the data signal generated in the data driver 300 is controlled by the first luminance control signal (Vc1) corresponding to a brightness of the ambient light, and therefore the entire brightness of the display area 100 is adjusted according to the brightness of the ambient light.

The first luminance control unit 400 generates a first luminance control signal (Vc1) for controlling a gamma-corrected gray level voltage of the data signal to correspond to an optical sensor signal (Ssens) supplied from the optical sensor 500, and provides the generated first luminance control signal (Vc1) to the data driver 300.

More particularly, the first luminance control unit 400 selects a gamma value according to control signals supplied from the outside, such as the vertical synchronizing signal (Vsync) and the clock signal (CLK), and the optical sensor signal (Ssens) supplied from the optical sensor 500, and outputs the first luminance control signal (Vc1) which is a gamma correction signal corresponding to the selected gamma value.

The first luminance control unit 400 outputs the first luminance control signal (Vc1) to increasingly reduce the luminance of the display area 100, as the optical sensor signal (Ssens) that corresponds to the increasingly darker brightness levels among the previously set levels of the brightness of the ambient light, is supplied to the first luminance control unit 400.

The optical sensor 500 has an optical sensor element such as a phototransistor or photodiode to sense a brightness of an external light, namely, the ambient light, and generates the optical sensor signal (Ssens) to correspond to the brightness of the ambient light. The optical sensor signal (Ssens) generated in the optical sensor 500 is supplied to the first luminance control unit 400 and the second luminance control unit 600.

The second luminance control unit 600 generates a second luminance control signal (Vc2) for controlling a pulse width of the light emission control signal in accordance with the optical sensor signal (Ssens) supplied from the sensor 500, and the data (RGB Data) of one frame, and provides the generated second luminance control signal (Vc2) to the scan driver 200.

In one exemplary embodiment, the second luminance control unit 600 is controlled to be turned on or off in accordance with the optical sensor signal (Ssens). For example, the second luminance control unit 600 may be controlled to be turned off if the optical sensor signal (Ssens) having a value less than a reference value (e.g., a previously set value or a predetermined value) is supplied to the second luminance control unit 600, and controlled to be turned on if the optical sensor signal (Ssens) having a value greater than the reference value (e.g., the previously set value or the predetermined value) is supplied. In other words, it is determined whether or not an operation of the second luminance control unit 600 is carried out according to the optical sensor signal (Ssens), and therefore it is determined whether or not the fluctuated value is generated.

While this embodiment is described in detail, assuming that an analog optical sensor signal (Ssens) is supplied from the optical sensor 500 to the second luminance control unit 600, the present invention is not limited thereto. For example, in one embodiment, an analog/digital converter (not shown) is provided inside the optical sensor 500, and therefore it may convert an analog optical sensor signal (Ssens) into a digital signal, for example, a 1-bit digital signal having a value of '0' or '1' and provide the 1-bit digital signal to the second luminance control unit 600. In this case, the second luminance control unit 600 may be set so that it can be turned on/off in accordance with the digital signal supplied to the second luminance control unit 600.

If the optical sensor signal (Ssens) that turns on the second luminance control unit 600 is supplied, the second luminance control unit 600 generates a second luminance control signal (Vc2) to correspond to the sum-up value of the data (RGB Data) supplied to the second luminance control unit 600 during one frame period, a synchronizing signal (Vsync), a clock signal (CLK) and the like. Therefore, a light emission time of the pixels is reduced.

According to the above-mentioned organic light emitting display device in one embodiment of the present invention, the luminance of the display area 100 is controlled to correspond to the brightness of the ambient light and the data of one frame.

More particularly, the problem that visibility is varied according to the surrounding brightness can be solved by controlling a gamma-corrected gray level voltage of the data signal to control the luminance of the display area 100 in accordance with the brightness of the ambient light, and also a power consumption can be reduced by preventing the luminance of the display area 100 from being set to an excessively bright level when the ambient light is dark.

Also, when the brightness of the ambient light has a value greater than the reference value (e.g., the predetermined value) and there are many pixels displaying high gray levels during one frame period, an excessive electric current may be prevented from flowing to the display area 100 and a power consumption may be reduced, by controlling the luminance of the display area 100 corresponding to the data of one frame through limiting the pulse width (or width) of the light emission control signal to control an amount of electric current flowing to the display area 100.

Also, the excessive reduction of luminance may be prevented by setting the luminance of the display area 100 so that the optical sensor 500 can turn off the second luminance control unit 600 if the brightness of the ambient light has a lower value than the reference value (e.g., the predetermined value), for example, if the luminance of the display area 100 is maximally limited by the first luminance control unit 400. For example, in the darkest brightness level in the brightness of the ambient light, if the amount of electric current (namely, an amount of electric current according to the light emission time of the pixels 110) flowing to the display area 100 is maximally limited by using the first luminance control signal (Vc1) generated in the first luminance control unit 400, then the excessive reduction in luminance may be prevented by turning off the second luminance control unit 600. In this case, it is possible to prevent unnecessary power consumption and the reduction to the safety margin for memory operation, caused by the operation of the second luminance control unit 600.

Figure 2:
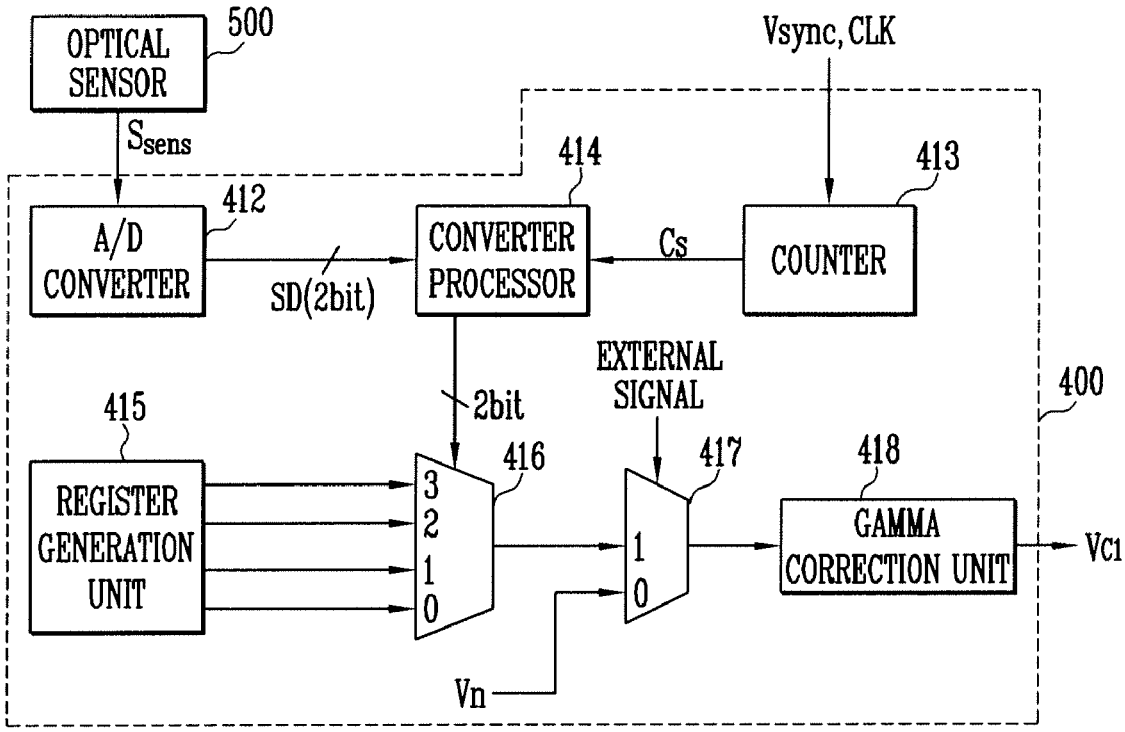
FIG. 2 is a block diagram showing one exemplary embodiment of a first luminance control unit shown in FIG. 1.

FIG. 2 is a block diagram showing one embodiment of the first luminance control unit 400 shown in FIG. 1.

Referring to FIG. 2, the first luminance control unit 400 in one embodiment includes an analog/digital converter 412, a counter 413, a converter processor 414, a register generation unit 415, a first selector 416, a second selector 417 and a gamma correction unit 418.

The analog/digital converter (hereinafter, referred to as an A/D converter) 412 compares an analog optical sensor signal (Ssens) outputted from the optical sensor 500 to a reference voltage (e.g., a predetermined reference voltage), and outputs a digital sensor signal (SD) corresponding to the reference voltage.

For example, in one embodiment, when the A/D converter 412 divides a surrounding brightness into four levels and outputs a 2-bit digital sensor signal (SD) according to the surrounding brightness, the A/D converter 412 may output a digital sensor signal (SD) of "11" in the brightest surrounding brightness level, and output a digital sensor signal (SD) of "10" in a relatively bright surrounding brightness level. Also, the A/D converter 412 may output a digital sensor signal (SD) of "01" in a relatively dark surrounding brightness level, and output a digital sensor signal (SD) of "00" in the darkest surrounding brightness level.

The counter 413 counts a number (e.g., a predetermined number) of pulses (e.g., clock cycles of a clock signal (CLK)) during a certain time, for example during one frame period, by using a vertical synchronizing signal (Vsync) supplied from the outside, and outputs a counting signal (Cs) corresponding to the number (e.g., a predetermined number) of pulses.

For example, in the case of the counter 413 using the binary value having 2 bits, the counter 413 is reset to a value of '00' when the vertical synchronizing signal (Vsync) is inputted, and then the number to '11' may be counted by sequentially shifting the clock signal (CLK). In one embodiment, as those skilled in the art would appreciate, the clock signal (CLK) has a period (i.e., clock cycle) equal to ¼ of one frame of an image (e.g., a video image), such that the clock signal (CLK) is used by the counter 413 to count from '00' to '11' during one frame, and then the counter 413 is re-set to a reset state when the vertical synchronizing signal (Vsync) is inputted to the counter 413 again after one frame.

As in the above operation, the counter 413 sequentially counts the number from '00' to '11' and outputs a counting signal (Cs) corresponding to the counted number into the converter processor 414. This way, the counting signal (Cs) changes through '00', '01', '10' and '11' during one frame and back to '00' at the end of the frame (i.e., in synchronization with the Vsync signal).

The converter processor 414 uses the digital sensor signal (SD) inputted from the A/D converter 412 and the counting signal (Cs) inputted from the counter 413 to output a control signal which will select a set value of each of the registers.

In other words, the converter processor 414 outputs a control signal corresponding to the digital sensor signal (SD) selected when the counting signal (Cs) outputted by the counter 413 is identical to the digital sensor signal (SD), and sustains the control signal until the next time when the digital sensor signal (SD) matches the counting signal (Cs). This way, the outputted control signal can be changed in the next frame when the digital sensor signal (SD) inputted from the A/D converter 412 is identical to the counting signal (Cs) inputted from the counter 413.

For example, if the ambient light is in the brightest state, then the converter processor 414 outputs a control signal (for example, a control signal set to 2-bit value such as '11') corresponding to the digital sensor signal (SD) of '11', and sustains the control signal until the digital sensor signal (SD) again matches the counting signal (Cs) outputted by the counter 413 according to the clock cycles (or pulses) of the clock signal (CLK). If the ambient light is in the darkest state, then the converter processor 414 outputs a control signal corresponding to the digital sensor signal (SD) of '00', and sustains the control signal until the digital sensor signal (SD) again matches the counting signal (Cs) outputted by the counter 413 according to the clock cycles (or pulses) of the clock signal (CLK). When the ambient light is in a relatively bright or dark state, the converter processor 414 outputs a control signal corresponding to the digital sensor signal (SD) of '10' or '01' and sustains the control signal until the next time when the digital sensor signal (SD) matches the counting signal (Cs) in the same manner as described above. In other embodiments, the control signal may be sustained during one or more frames or a partial frame using other methods as those skilled in the art would appreciate.

The register generation unit 415 divides a brightness of the ambient light into a plurality of brightness levels and stores a plurality of register set values corresponding to the brightness levels.

The first selection unit 416 selects register set values corresponding to the control signals, set by the converter processor 414, among the a plurality of the register set values stored in the register generation unit 415, and then outputs one of the selected register set values.

The second selection unit 417 may receive a 1-bit set value for controlling ON/OFF from the outside, and selectively control the brightness according to the ambient light by operating the first luminance control unit 400 if a value of '1' is selected as the 1-bit set value, and turning off the first luminance control unit 400 if a value of '0' is selected as the 1-bit set value. Hereinafter, the embodiment of the invention will be described in reference to a case where an operation of the first luminance control unit 400 is carried out. In this case, the second selection unit 417 supplies the register set value, supplied from the first selection unit 416, to the gamma correction unit 418.

The gamma correction unit 418 generates a first luminance control signal (Vc1) which is a gamma correction signal corresponding to the register set values supplied from the second selection unit 417. Here, the first luminance control signal (Vc1) has different values according to the brightness of the ambient light since the register set values supplied to the gamma correction unit 418 correspond to the optical sensor signal (Ssens) inputted from the optical sensor 500. In one embodiment, the luminance of the display area is set so that it can be reduced if the gamma correction signal is a gamma correction signal corresponding to the darkest brightness level in the brightness of the ambient light. Such an operation is carried out in each of subpixels, for example, red (R), green (G) and blue (B) subpixels, respectively.

Figure 3:
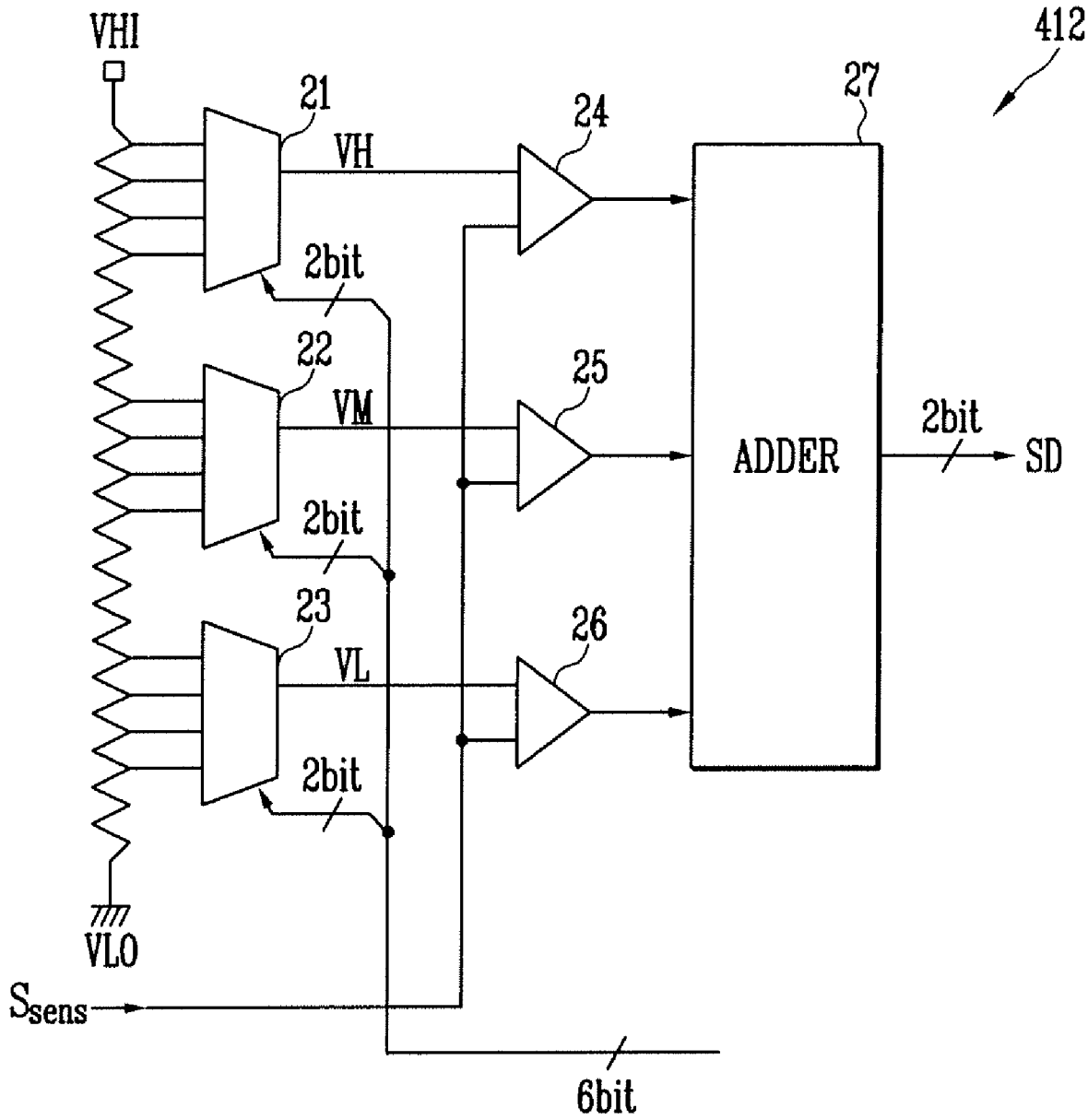
FIG. 3 is a block diagram showing one exemplary embodiment of an A/D converter shown in FIG. 2.

FIG. 3 is a diagram showing one exemplary embodiment of the A/D converter 412 shown in FIG. 2.

Referring to FIG. 3, the A/D converter 412 includes first, second and third selectors 21, 22, 23, first, second and third comparators 24, 25, 26 and an adder 27.

The first to third selectors 21, 22, 23 receive a plurality of gray level voltages distributed through a plurality of resistance arrays for generating a plurality of gray level voltages (VHI to VHO), and output the gray level voltages corresponding to differently set 2-bit values, which is referred to as reference voltages (VH, VM and VL).

The first comparator 24 compares the analog optical sensor signal (Ssens) with a first reference voltage (VH) and outputs the resultant value. For example, the first comparator 24 may output "1" if an analog optical sensor signal (Ssens) is higher than the first reference voltage (VH), and "0" if an analog optical sensor signal (Ssens) is lower than the first reference voltage (VH).

In the same manner, the second comparator 25 outputs a value obtained by comparing the analog optical sensor signal (Ssens) with a second reference voltage (VM), and the third comparator 26 outputs a value obtained by comparing the analog optical sensor signal (Ssens) with a third reference voltage (VL).

Also, an area of the analog optical sensor signal (Ssens) corresponding to the same digital sensor signal (SD) may be changed by varying the first to third reference voltages (VH to VL).

The adder 27 adds up all of the resultant values outputted from the first to third comparator 24, 25, 26 and outputs the values as a 2-bit digital sensor signal (SD).

Hereinafter, an operation of the A/D converter 412 shown in FIG. 3 will be described in detail, assuming that the first reference voltage (VH) is set to 3V, the second reference voltage (VM) is set to 2V, the third reference voltage (VL) is set to 1V, and a voltage value of the analog optical sensor signal (Ssens) is increased as the ambient light becomes brighter.

If the analog optical sensor signal (Ssens) has a lower voltage than 1V, then all of the first to third comparators 24, 25, 26 output '0', and therefore the adder 27 outputs a digital sensor signal (SD) of '00'.

Also, if the analog optical sensor signal (Ssens) has a voltage between 1V and 2V, then the first to third comparators 24, 25, 26 output '0', '0', '1', respectively, and therefore the adder 27 outputs a digital sensor signal (SD) of '01'.

In the same manner, if the analog optical sensor signal (Ssens) has a voltage between 2V and 3V, then the adder 27 outputs a digital sensor signal (SD) of '10', and if the analog optical sensor signal (Ssens) has a higher voltage than 3V or more, then the adder 27 outputs a digital sensor signal (SD) of '11'.

The A/D converter 412 divides a brightness of the ambient light into four brightness levels while being driven in the above-mentioned manner, and then outputs '00' in the darkest brightness level, outputs '01' in a relatively dark brightness level, outputs '10' in a relatively bright brightness level, and outputs '11' in the brightest brightness level.

Figure 4:
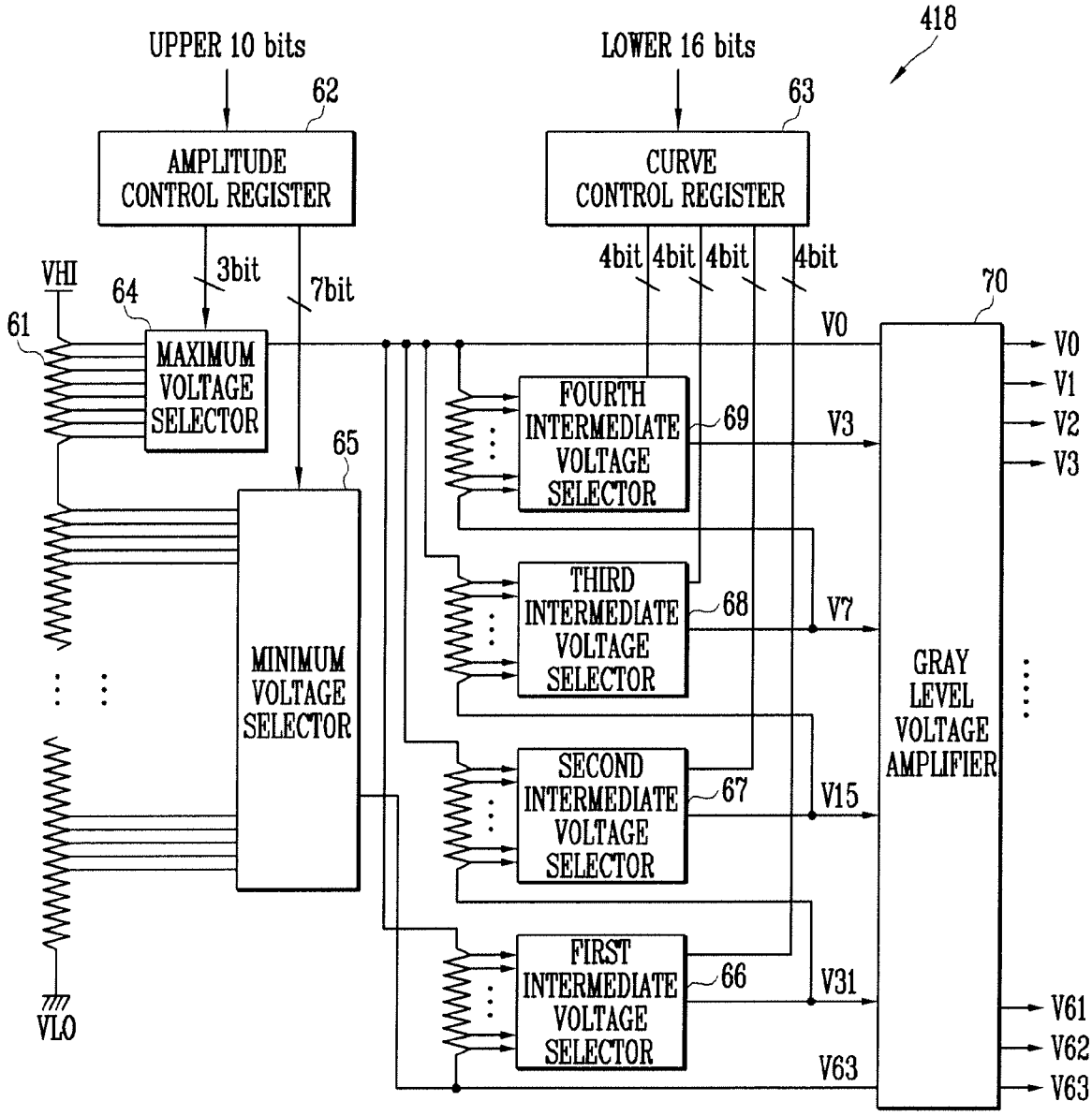
FIG. 4 is a block diagram showing one exemplary embodiment of a gamma correction unit shown in FIG. 2.

FIG. 4 is a diagram showing one example of a gamma correction unit shown in FIG. 2.

Referring to FIG. 4, the gamma correction unit 418 includes a ladder resistor 61, an amplitude control register 62, a curve control register 63, a maximum voltage selector 64, a minimum voltage selector 65, first, second third and fourth intermediate voltage selectors 66, 67, 68 and 69, and a gray level voltage amplifier 70.

The ladder resistor 61 sets the highest level voltage (VHI), supplied from the outside, as a reference voltage, and includes a plurality of variable resistors connected in series between the lowest level voltage (VLO) and the reference voltage (VHI). In this case, a plurality of gray level voltages are generated through the ladder resistor 61.

On one hand, if the ladder resistor 61 is set to a low value, amplitude modulation range becomes narrow but its modulation accuracy is improved. On the other hand, if the ladder resistor 61 is set to a high value, amplitude modulation range becomes wide but its modulation accuracy is deteriorated.

The amplitude control register 62 supplies size data to the maximum voltage selector 64 and the minimum voltage selector 65, respectively. The size data determines the sizes of the highest gray level voltage and the lowest gray level voltage.

For example, the amplitude control register 62 may receive an upper 10-bit value among the register set values, and then output the uppermost (or most significant) 3-bit register set values into the maximum voltage selector 64 and output 7-bit register set values to the minimum voltage selector 65. At this time, the number of gray levels to be selected may be increased by increasing the set bit number and a gray level voltage may be differently selected by varying the register set values.

The maximum voltage selector 64 selects a gray level voltage corresponding to the 3-bit register set values, supplied from the amplitude control register, among a plurality of the gray level voltages distributed through the ladder resistor 61, and then outputs the selected gray level voltage as the highest voltage (V0) for displaying the lowest gray levels.

The minimum voltage selector 65 selects a gray level voltage corresponding to the 7-bit register set values, supplied from the amplitude control register, among a plurality of the gray level voltages distributed through the ladder resistor 61, and then outputs the selected gray level voltage as the lowest voltage (V63) for displaying the highest gray levels.

The curve control register 63 outputs gamma data into a plurality of intermediate voltage selectors 66, 67, 68 and 69, respectively, the gamma data being capable of improving or optimizing display characteristics of the display area 100.

For example, the curve control register 63 may receive a lower 16-bit value among the register set values, and output a 4-bit register set value into the first to fourth intermediate voltage selectors 66 to 69, respectively. At this time, the register set value may be varied, and the gray level voltage, which may be selected according to the register set value, may be also adjusted.

Here, the upper 10-bit values among the register values generated in the register generation unit 415 are inputted into the amplitude control register 62, and the lower 16-bit values are inputted into the curve control register 63, and then the upper 10-bit values and the lower 16-bit values are selected as the register set values.

The first to fourth intermediate voltage selectors 66 to 69 select intermediate voltages corresponding to inflection points whose inclination is changed in a gamma curve showing a relation of the gamma-corrected gray level voltages corresponding to gray levels so as to correspond to the register set values supplied from the curve control register 63. Accordingly, the number of the intermediate voltage selectors 66 to 69 may be set to be the same as the number of the inflection points in the gamma curve showing the optimum display characteristics of the display area 100.

More particularly, the first intermediate voltage selector 66 distributes a voltage between the gray level voltage outputted from the maximum voltage selector 64 and the gray level voltage outputted from the minimum voltage selector 65 using a plurality of resistance arrays, and then selects and outputs the gray level voltages corresponding to the 4-bit register set values.

The second intermediate voltage selector 67 distributes a voltage between the gray level voltage outputted from the maximum voltage selector 64 and the gray level voltage outputted from the first intermediate voltage selector 66 using a plurality of resistance arrays, and then selects and outputs the gray level voltages corresponding to the 4-bit register set values.

The third intermediate voltage selector 68 distributes a voltage between the gray level voltage outputted from the maximum voltage selector 64 and the gray level voltage outputted from the second intermediate voltage selector 67 using a plurality of resistance arrays, and then selects and outputs the gray level voltages corresponding to the 4-bit register set values.

The fourth intermediate voltage selector 69 distributes a voltage between the gray level voltage outputted from the maximum voltage selector 64 and the gray level voltage outputted from the third intermediate voltage selector 68 using a plurality of resistance arrays, and then selects and outputs the gray level voltages corresponding to the 4-bit register set values.

In the operation as described above, it is possible to adjust a curve of the intermediate gray level unit according to the register set values of the curve control register 63, and therefore a gamma characteristic may be easily adjusted, depending on the characteristic of each of light emitting elements. Also, in order to bulge the gamma curve characteristic downward, a resistor value of the ladder resistor 61 is set so that an electric potential difference between the gray levels can be increased as a low gray level is displayed, while a resistor value of the ladder resistor 61 is set so that an electric potential difference between the gray levels can be decreased as a low gray level is displayed so as to bulge the gamma curve characteristic upward.

The gray level voltage amplifier 70 outputs a plurality of gray level voltages corresponding to a plurality of gray levels displayed in the display area 100, respectively. For the sake of convenience, an output of the gray level voltage corresponding to 64 gray levels is shown in FIG. 4. However, the present invention is not limited thereto.

More particularly, the gray level voltage amplifier 70 receives intermediate voltages from the plurality of the intermediate voltage selectors 66 to 69, generates a plurality of voltage levels as the gray level voltages and outputs each of the gray level voltages, wherein a plurality of the voltage levels have a linear relation within two intermediate voltage ranges and the gray level voltages may display all of the gray levels. In one embodiment, the gray level voltage amplifier 70 is composed of a plurality of resistors having the same resistance and connected in series. However, the present invention is not limited thereto.

The above operation is carried out so that red (R), green (G), blue (B) subpixels can obtain substantially the same luminance characteristic, considering the changes in their own characteristics of red (R), green (G), blue (B) light-emitting elements. For this purpose, the amplitude and the curve may be differently set in the red (R), green (G), blue (B) subpixels through the amplitude control register 62 and the curve control register 63 by installing the gamma correction unit 418 in every red (R), green (G), blue (B) subpixel groups.

Figure 5A:
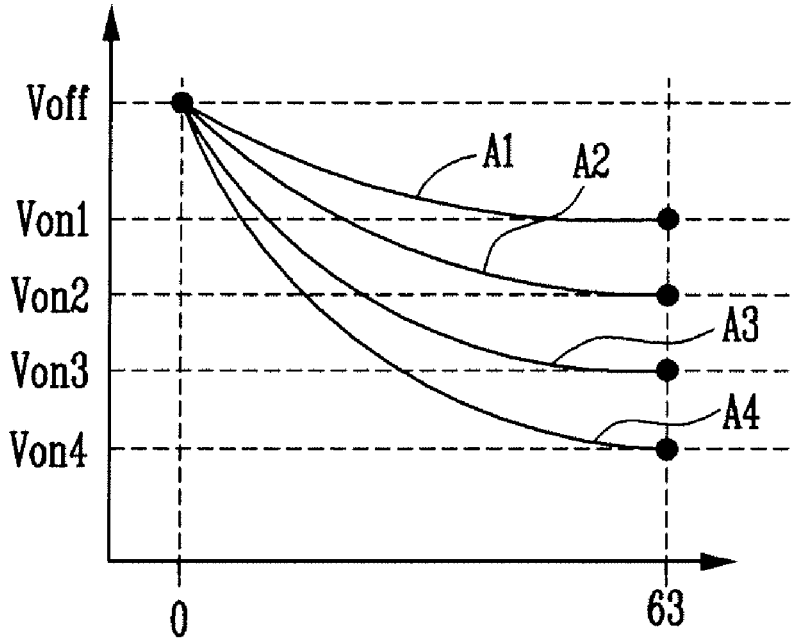
FIG. 5A and FIG. 5B are graphs showing a gamma curve according to the gamma correction unit shown in FIG. 4.
Figure 5B:
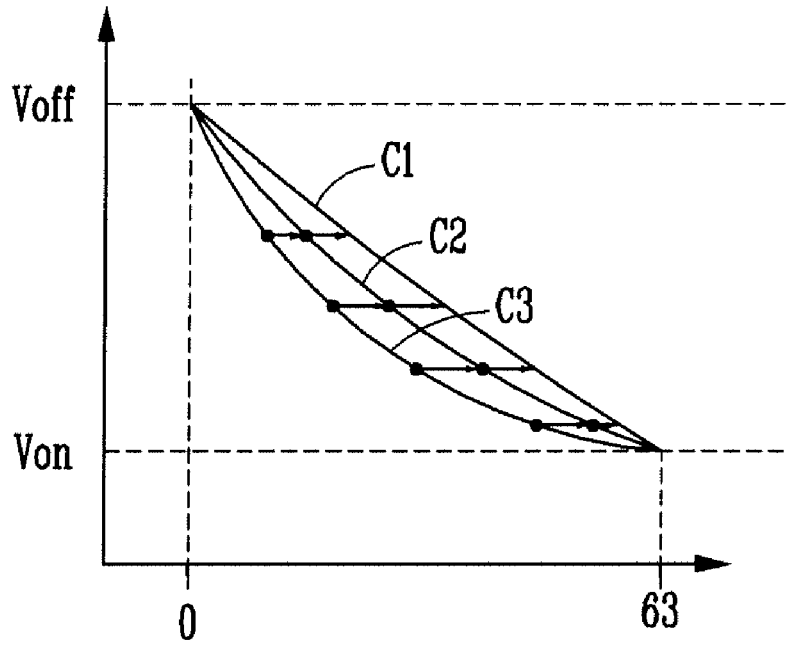

FIG. 5A and FIG. 5B are graphs showing a gamma curve according to the gamma correction circuit 418 shown in FIG. 4.

FIG. 5A shows that the highest voltage for displaying the lowest gray level is not changed, and amplitude of the lowest voltage for displaying the highest gray level may be adjusted according to the 7-bit register set value outputted by the amplitude control register 62. Here, an OFF voltage (Voff) is a voltage corresponding to a black gray level (a gray level value of 0), and an ON voltage (Von) is a voltage corresponding to a white gray level (a gray level value of 63).

A reference numeral A1 represents a gamma curve corresponding to the digital sensor signal (SD) when the surrounding brightness is in the darkest state, and a reference numeral A2 represents a gamma curve corresponding to the digital sensor signal (SD) when the surrounding brightness is in a relatively dark state. Also, a reference numeral A3 represents a gamma curve corresponding to the digital sensor signal (SD) when the surrounding brightness is in a relatively bright state, and a reference numeral A4 represents a gamma curve corresponding to the digital sensor signal (SD) when the surrounding brightness is in the brightest state. In the gamma curves A1, A2, A3 and A4, an off voltage Voff corresponds to a black gray scale level (i.e., gray level value of 0) and on voltages Von1, Von2, Von3 and Von4, respectively, correspond to a white gray scale level (i.e., gray level value of 63).

In one embodiment, in order to reduce the amplitude range of the gray level voltage, the minimum voltage selector 65 is set to select the highest voltage level by adjusting a register set value of the amplitude control register 62. Also, in order to increase the amplitude range of the gray level voltage, the minimum voltage selector 65 is set to select the lowest voltage level.

FIG. 5B shows that a gamma curve is adjusted by changing an intermediate level of the gray level voltage according to the register set values supplied by the register curve control register 63, without changing the highest voltage for displaying the lowest gray level and the lowest voltage for displaying the highest gray level.

The 4-bit register set values are respectively inputted into the first to fourth intermediate voltage selectors 66 to 69, and four gamma values corresponding to the register set values are selected to generate a gamma curve. As can be seen in FIG. 5B, the change in inclination of a C2 curve is higher than the change in inclination of a C1 curve and lower than the change in inclination of a C3 curve.

As shown in FIG. 5A and FIG. 5B, the gray level voltages are changed to form a gamma curve by changing a set value of the gamma control register. Accordingly, it has been illustrated that brightness of each of the pixels 110 in the display area 100 may be adjusted.

Figure 6:
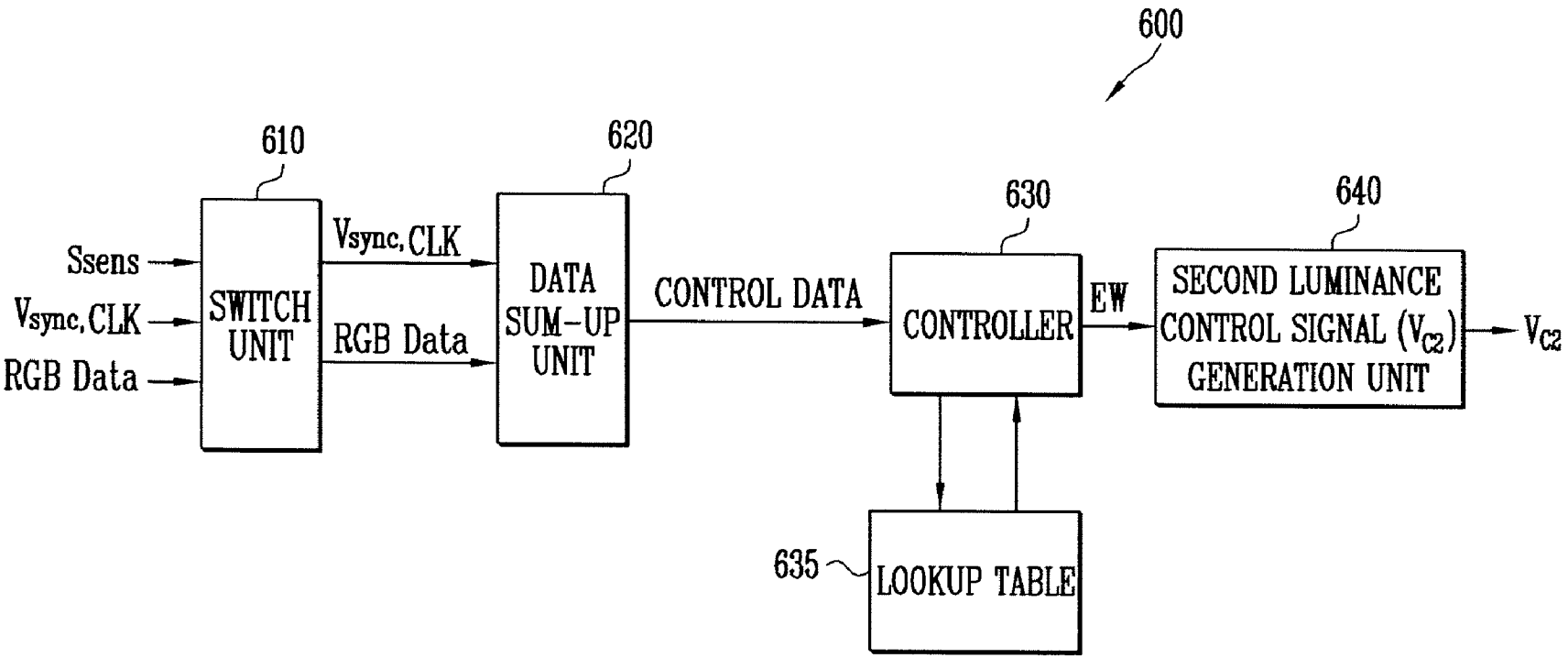
FIG. 6 is a block diagram showing one exemplary embodiment of a second luminance control unit shown in FIG. 1.

FIG. 6 is a block diagram showing one exemplary embodiment of the second luminance control unit 600 shown in FIG. 1.

Referring to FIG. 6, the second luminance control unit 600 includes a switch unit 610, a data sum-up unit 620, a controller 630, a lookup table 635 and a second luminance control signal (Vc2) generation unit 640.

The switch unit 610 transmits the control signals such as a synchronizing signal (Vsync) and a clock signal (CLK), and data (RGB Data) of one frame to the data sum-up unit 620, or interrupts their transmission to the data sum-up unit 620 to correspond to the optical sensor signal (Ssens) supplied from the optical sensor 500. In one embodiment, the clock signal (CLK) inputted into the second luminance control unit 600 is identical to the clock signal (CLK) inputted into the first luminance control unit 400. In other embodiments, the clock signals (CLK) may be similar or different.

For example, the switch unit 610 supplies the control signals such as the synchronizing signal (Vsync) and the clock signal (CLK), and the data (RGB Data) of one frame to the data sum-up unit 620 to correspond to the selection signal (Ssel) if the optical sensor signal (Ssens) having a value greater than a reference value (e.g., a predetermined value) that directs ON of the second luminance control unit 600 is inputted. Further, the switch unit 610 interrupts the supply of the control signals such as the synchronizing signal (Vsync) and the clock signal (CLK), and the data (RGB Data) of one frame to the data sum-up unit 620 in the other case, that is, if the optical sensor signal (Ssens) having a value greater than a reference value (e.g., a predetermined value) that directs OFF of the second luminance control unit 600 is inputted.

The data sum-up unit 620 generates sum-up data obtained by adding up image data (RGB Data) inputted during one frame period, and generates, control data having at least two bits including the uppermost bits (i.e., the most significant bits) of the sum-up data. Hereinafter, it will be assumed that an upper (i.e., most significant) 5-bit value of the sum-up data is set to the control data for the sake of convenience. Here, a high value of the sum-up data means that the data sum-up unit 620 includes a large amount of data having a high luminance more than a reference luminance (e.g., a predetermined luminance), and a low value of the sum-up data means that the data sum-up unit 620 includes a small amount of data having a high luminance more than the reference luminance (e.g., the predetermined luminance). The control data generated in the data sum-up unit 620 is transmitted to the second controller 630.

The lookup table 635 stores a width (EW) information of the light emission control signal corresponding to the control data (for example, control data from 0 to 31 if the control data is set to a 5-bit value). Here, the width (EW) of the light emission control signal is a data value having information on the width of the light emission control signal for controlling a light emission time of the pixels 110, and the width (EW) of the light emission control signal stored in the lookup table 635 is set so that the luminance of the display area 100 can be reduced with an increasing value of the control data. That is to say, the width (EW) of the light emission control signal is set to limit an amount of electric current flowing to the display area 100 by reducing a light emission time of the pixels 110 as the value of the control data increases.

The controller 630 extracts from the lookup table 635 the width (EW) information of the light emission control signal that corresponds to the control data supplied from the data sum-up unit 620, and transmits the extracted width (EW) information to the second luminance control signal (Vc2) generation unit 640.

The second luminance control signal (Vc2) generation unit 640 generates a second luminance control signal (Vc2) corresponding to the width (EW) information of the light emission control signal supplied from the controller 630, and outputs the generated second luminance control signal (Vc2) to the scan driver 200.

FIG. 7 is a block diagram showing one exemplary embodiment of the lookup table 635 shown in FIG. 6. The lookup table 635 shown in FIG. 7 is based on an assumption that the amount of time that an electric current flows to the pixel 110 increases as the width (EW) of the light emission control signal increases, but the description provided herein is not intended to limit the scope of the invention. In practice, the content stored in the lookup table 635 may be varied depending on the configuration of the pixel circuits, the resolution and size of the display area 100, etc., as those skilled in the art would appreciate.

Referring to FIG. 7, the width (EW) of the light emission control signal corresponding to an upper 5-bit value (namely, the control data) of the sum-up data is stored in the lookup table 635. Here, the width (EW) of the light emission control signal is set so that it can be narrowed with an increasing value of the control data so as to limit a power consumption within a constant range (in other words, to limit luminance). Here, if the control data has at least one value including the minimum value, then the width (EW) of the light emission control signal is sustained at a constant width.

By way of example, if the control data is set to a value of '4' or less, the width (EW) of the light emission control signal is set to a width corresponding to 325 cycles of a horizontal synchronizing signal (Hsync) so as not to limit the luminance. As described above, when the control data has at least one value including the minimum value, if the width (EW) of the light emission control signal is not limited, a contrast ratio may be improved when a dark image is displayed, and therefore an image having an improved contrast may be displayed.

If the control data is set to a value of '5' or more, then the width (EW) of the light emission control signal is slowly narrowed with an increasing value of the control data. As described above, if the control data has a higher value than at least one value including the minimum value, then the power consumption may be sustained within a constant range since the luminance is lowered as the width (EW) of the light emission control signal gets narrow. Also, eye fatigue may be alleviated due to the limited luminance of the display area 100 even if one watches images for a long time. Actually, a ratio for limiting the luminance is increased since the increased number of pixels displaying high gray levels increases the value of the control data.

In order to prevent the excessive reduction of the luminance, a maximum limitation ratio for the luminance is defined, and therefore the pixels 110 displaying high gray levels are set to have a light emitting ratio of 34% or less even if these pixels 110 having high gray levels take a majority of an area of the display area 100. In other words, if the control data has a higher value than at least one value including the minimum value, then the width (EW) of the light emission control signal should not be set to a width less than a reference width (e.g., a predetermined width). In one embodiment, the lookup table 635 is applied to a moving image. Actually, if an image displayed in the organic light emitting display device is a still image and a moving image, the limited range of the luminance is varied according to kinds of the image. For example, in one embodiment, the maximum limitation ratio of the luminance may reach 50% in the case of the still image.

As described above, the organic light emitting display device according to exemplary embodiments of the present invention may be useful to control the luminance of the display area to correspond to the luminance of the ambient light and the data of one frame. In other words, the problem that visibility is varied according to the surrounding brightness can be solved by controlling the gamma-corrected gray level voltage of the data signal to control the luminance of the display area to correspond to the brightness of the ambient light, and also a power consumption can be reduced by preventing the luminance of the display area from being set to an excessively bright level when the ambient light is dark. Also, an excessive electric current may be prevented from flowing to the display area and a power consumption may be reduced by controlling the luminance of the display area to correspond to the data of one frame if the brightness of the ambient light has a value greater than the reference value (e.g., the predetermined value), and limiting the pulse width of the light emission control signal to control an amount of electric current flowing to the display area if there are many pixels displaying high gray levels during one frame period.

Also, if the brightness of the ambient light has a lower value than the reference value (e.g., the predetermined value), for example, if the luminance of the display area is maximally limited by using the first luminance control unit, the excessive reduction in luminance may be prevented by turning off the second luminance control unit using the optical sensor output. In this case, it is possible to prevent unnecessary power consumption and the reduction to the safety margin for memory operation, caused by the operation of the second luminance control unit.

The description provided herein is just exemplary embodiments for the purpose of illustrations only, and not intended to limit the scope of the invention, so it should be understood that other equivalents and modifications could be made thereto without departing from the spirit and scope of the invention as those skilled in the art would appreciate. Therefore, it should be understood that the present invention has a scope that is defined in the claims and their equivalents.

What is claimed is:

1. An organic light emitting display device for displaying an image, the organic light emitting display device having a plurality of scan lines, a plurality of light emission control lines and a plurality of data lines, and comprising:

a display area including a plurality of pixels coupled to the scan lines, the light emission control lines and the data lines;

a scan driver electrically coupled to the display area through the scan lines and the light emission control lines;

a data driver electrically coupled to the display area through the data lines;

an optical sensor for generating an optical sensor signal corresponding to a brightness of an ambient light;

a first luminance control unit for providing to the data driver a first luminance control signal for controlling a gamma-corrected gray level voltage of a data signal applied to the data lines, in accordance with the optical sensor signal; and a second luminance control unit for providing to the scan driver a second luminance control signal for controlling a width of a light emission control signal applied to the light emission control lines, in accordance with the optical sensor signal and data of one frame of the image.

2. The organic light emitting display device according to claim 1, wherein the second luminance control unit is turned on or off according to the optical sensor signal.

3. The organic light emitting display device according to claim 2, wherein the second luminance control unit is turned off when the optical sensor signal has a lower value than a reference value, and is turned on when the optical sensor signal has a higher value than the reference value.

4. The organic light emitting display device according to claim 1, wherein the first luminance control unit comprises:

an analog/digital converter for converting the optical sensor signal, which is an analog signal, into a digital sensor signal;

a counter for counting pulses to generate a counting signal during one frame period;

a converter processor for outputting a control signal corresponding to the digital sensor signal and the counting signal;

a register generation unit for dividing a brightness of the ambient light into a plurality of brightness levels and storing a plurality of register set values corresponding to the brightness levels;

a first selection unit for selecting one register set value corresponding to the control signal outputted by the converter processor, among the plurality of the register set values stored in the register generation unit and outputting the selected one register set value; and a gamma correction unit for generating the first luminance control signal, which is a gamma correction signal, corresponding to the selected one register set value supplied from the first selection unit.

5. The organic light emitting display device according to claim 4, wherein the gamma correction signal is set so that a luminance of the display area is reduced if the digital sensor signal corresponds to a dark brightness level of the ambient light.

6. The organic light emitting display device according to claim 1, wherein the second luminance control unit comprises:

a data sum-up unit for summing up the data of one frame to generate sum-up data and generating, as control data, at least two bit values including most significant bits of the sum-up data;

a lookup table for storing a width information of the light emission control signal corresponding to the control data;

a controller for extracting the width information of the light emission control signal corresponding to the control data from the lookup table; and a second luminance control signal generation unit for generating the second luminance control signal corresponding to the width information of the light emission control signal supplied from the controller.

7. The organic light emitting display device according to claim 6, wherein the width of the light emission control signal is set so that a luminance of the display area is decreased with an increasing value of the control data.

8. The organic light emitting display device according to claim 6, wherein the second luminance control unit further comprises a switch unit for transmitting the data of one frame to the data sum-up unit or interrupting transmission of the data of the one frame to the data sum-up unit according to the optical sensor signal.

9. An organic light emitting display device for displaying an image, the organic light emitting display device having a plurality of scan lines, a plurality of light emission control lines and a plurality of data lines, and comprising:

a display area including a plurality of pixels coupled to the scan lines, the light emission control lines and the data lines;

a scan driver electrically coupled to the display area through the scan lines and the light emission control lines;

a data driver electrically coupled to the display area through the data lines;

an optical sensor for generating an optical sensor signal corresponding to a brightness of an ambient light;

a first luminance control unit for adjusting a brightness of the image according to the optical sensor signal; and a second luminance control unit for adjusting the brightness of the image according to gray levels of data representing the image, wherein an operation of the second luminance control unit is in accordance with the optical sensor signal.

10. The organic light emitting display device of claim 9, wherein the second luminance control unit is turned off or on according to the optical sensor signal.

11. The organic light emitting display device of claim 10, wherein the second luminance control unit is turned off if the optical sensor signal indicates that the ambient light has a brightness below a reference brightness level.

12. The organic light emitting display device of claim 9, wherein the first luminance control unit provides to the data driver a control signal for controlling a gamma-corrected gray level voltage of a data signal applied to the data lines.

13. The organic light emitting display device of claim 9, wherein the second luminance control unit provides to the scan driver a control signal for controlling a width of a light emission control signal applied to the light emission control lines.

* * * * *

UNITED STATES PATENT AND TRADEMARK OFFICE

CERTIFICATE OF CORRECTION

PATENT NO. : 8,094,098 B2
APPLICATION NO. : 11/861112
DATED : January 10, 2012
INVENTOR(S) : Wook Lee It is certified that error appears in the above-identified patent and that said Letters Patent is hereby corrected as shown below:

On the Title Page

| | |
|---|---|
| Item (56) References Cited OTHER | Delete "192-0004293" |
| PUBLICATIONS, page 2, right column, line 22 | Insert -- 1992-0004293 -- |

Signed and Sealed this
Twenty-seventh Day of August, 2013

Teresa Stanek Rea
*Acting Director of the United States Patent and Trademark Office*